United States Patent [19]

Blanchett et al.

[11] 4,335,552

[45] Jun. 22, 1982

[54] GLAZING BEAD

[76] Inventors: Paul T. Blanchett, 17557 Wallingford Ave. North, Seattle, Wash. 98133; Philip J. Blanchett, 8816 Shell Place Rd., Edmonds, Wash. 98020

[21] Appl. No.: 221,882

[22] Filed: Dec. 31, 1980

[51] Int. Cl.[3] ..... E06B 3/26

[52] U.S. Cl. ..... 52/202; 52/716; 52/400; 52/773

[58] Field of Search ..... 52/398, 397, 773, 716, 52/400, 202, 465, 468, 471

[56] References Cited

U.S. PATENT DOCUMENTS

| | | | |
|---|---|---|---|
| 2,084,103 | 6/1937 | Miller | 52/398 |
| 2,094,435 | 9/1937 | Toney | 52/398 |
| 2,807,339 | 9/1957 | Wagner | 52/398 X |
| 2,934,800 | 5/1960 | Hasbrouck et al. | 52/398 X |
| 3,152,369 | 10/1964 | Gottesleben | 52/790 X |
| 3,212,225 | 10/1965 | Neal | 52/500 |
| 3,242,627 | 3/1966 | Fountain | 52/397 X |
| 3,250,663 | 5/1966 | Sharp et al. | 52/397 X |
| 3,694,984 | 10/1972 | Schwartz | 52/398 |
| 3,744,201 | 7/1973 | Dochnahl | 52/400 |
| 3,760,544 | 9/1973 | Hawes et al. | 52/400 X |
| 3,774,363 | 11/1973 | Kent | 52/400 |
| 3,940,897 | 3/1976 | Stoakes | 52/397 X |
| 3,992,843 | 11/1976 | DiFazio | 52/398 |
| 4,004,389 | 1/1977 | DiFazio | 52/790 X |
| 4,018,022 | 4/1977 | Fink | 52/398 |
| 4,147,005 | 4/1979 | Meyer | 52/397 |
| 4,231,204 | 11/1980 | Krueger et al. | 52/397 |

*Primary Examiner*—Carl D. Friedman

*Attorney, Agent, or Firm*—Gregory W. Moravan; Roy E. Mattern, Jr.; David H. Delts

[57] ABSTRACT

A glazing bead adapted to secure a second, larger thickness of insulated window in a window frame designed to normally receive a first, smaller thickness of insulated window. The glazing bead comprises a plastic extrusion having a resilient, arcuate wall member which engages the window and/or the window frame. Extending outwardly from the wall member is a folded leg member which is inserted between the window and the window frame, thereby compressing it and urging a locking flange on the folded leg member into engagement with the glazing lip on the window frame to secure the glazing bead and the window in place in the window frame. When the glazing bead is snapped into place, the arcuate wall member is compressed and thus resiliently urges said locking flange laterally towards and into engagement with said glazing lip on said window frame. This compression of the resilient wall member also tends to effectuate a seal between it and the window.

14 Claims, 10 Drawing Figures

FIG. 8
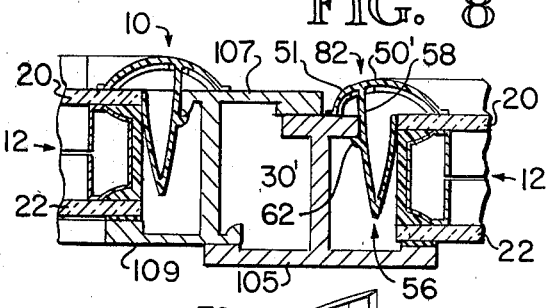
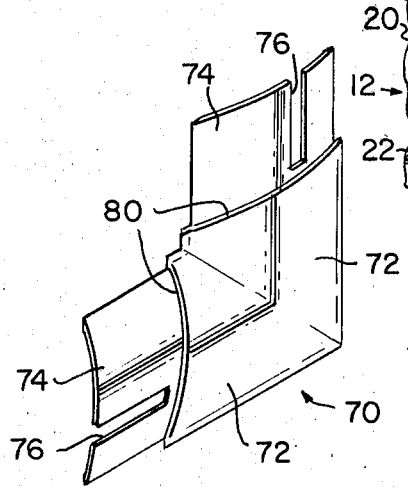
FIG. 4
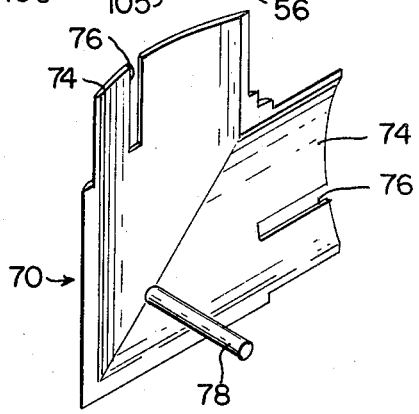
FIG. 5
FIG. 6
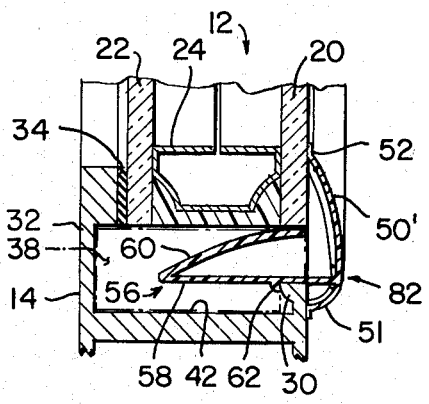
FIG. 7
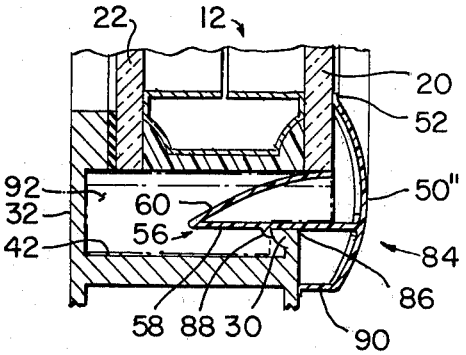
FIG. 9
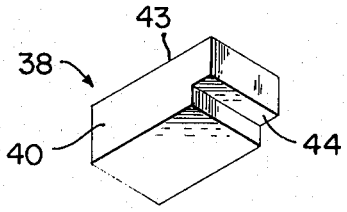
FIG. 10
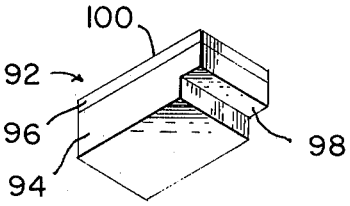

GLAZING BEAD

BACKGROUND OF THE INVENTION

The present invention relates to glazing beads, and more particularly to glazing beads adapted to secure an insulated window in a window frame; wherein the insulated window is of a thickness greater than the thickness of the insulated window which a particular window frame is designed to normally receive.

BRIEF SUMMARY OF THE INVENTION

Insulated windows are well known and generally comprise multiple layers of window pane, with adjacent layers being separated from each other by an air space. Double pane insulated windows are perhaps most commonly used, although three or more panes could be used. Naturally, insulated windows are ordinarily considerably thicker than common uninsulated windows.

Insulated windows are typically installed in a window frame having a glazing channel terminating on one side in a glazing lip.

It is a primary object of the present invention to provide a glazing bead which is adapted to secure a second, larger thickness of insulated window in a window frame designed to normally receive a first, smaller thickness of insulated or non-insulated window.

In basic form, the glazing bead comprises a plastic extrusion having a resilient, arcuate wall member whose inner and outer lateral edges engage the window and the window frame, respectively. The lateral edges are preferably rounded to help effectuate a good water and wind resistant seal between the wall member and the window and the window frame.

Extending outwardly from the wall member is a folded leg member which is compressed between the window and the window frame. This compression of the folded leg member urges a locking flange on the folded leg member towards and into engagement with the glazing lip to secure the glazing bead, and thus the insulated window in place in the window frame.

As the glazing bead is being installed, the resilient wall member is compressed, and when released tends to spring back and tries to resume its original configuration. As it tends to spring back, it pulls the locking flange laterally towards and into engagement with the glazing lip, thereby also helping to lock the glazing bead in place to secure the window in the window frame. After installation of the glazing bead, the wall member is held in compression by the engagement of the locking flange with the glazing lip, thereby helping to seal the lateral edges of the glazing bead against the window and the window frame to help to prevent the entry of wind or rain.

In another form of the present invention, the arcuate wall member contacts only the window, with a wind and water resistant seal between the glazing bead and the window frame being provided by the folded leg member and its locking flange.

In still another form of the present invention, which is designed to be used with an insulated window so thick that it extends outwardly past the glazing lip, the arcuate wall member is provided with a foot having a width about equal to the amount of overhang of the insulated window past the glazing lip. The foot provides for proper seating of the glazing bead against the outer surface of the window frame despite said overhang of the insulated window.

Another object of the present invention is to provide a glazing bead of the type described above which can be installed with a snap fit into a previously assembled combination insulated window and window frame.

It is to be understood that the foregoing is but a brief summary, and is not intended to be a detailed catalog of the various features, objects, advantages and characteristics of the present invention, since these and further objects, features, advantages and characteristics of the present invention will be apparent from the following more detailed description of the preferred embodiments thereof.

BRIEF DESCRIPTION OF THE FIGURES

FIG. 4 is a front perspective view of a corner member used in conjunction with the glazing bead of the present invention;

FIG. 5 is a rear perspective view of the corner shown in FIG. 4;

FIG. 6 is a view, similar to FIG. 3, of a second form of the glazing bead of the present invention;

FIG. 7 is a view, similar to FIG. 3, of a third form of the present invention;

FIG. 8 is a cross-sectional view showing another installation of the second form of the invention;

FIG. 9 is a perspective view of one form of a glazing block used in conjunction with the present invention; and FIG. 10 is a perspective view of another form of a glazing block used in conjunction with the present invention.

DESCRIPTION OF THE PREFERRED EMBODIMENTS

Figure 1:
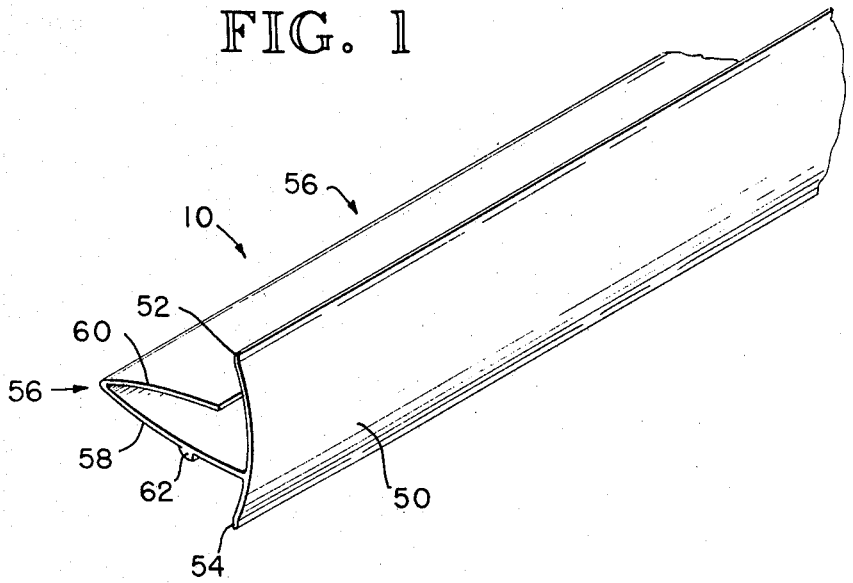
FIG. 1 is a front perspective view from an upper aspect of one form of the glazing bead of the present invention.

Referring now to the figures, the purpose of the glazing bead, generally designated at 10, is threefold: namely to help secure an insulated window, generally designated at 12, in a window frame, generally designated at 13; to help seal against the entry of wind and rain, and to help give a smart appearance to the installed window 12.

The window 12 is of conventional construction and uses one hollow spacing member 24 to separate corresponding edges of each side of the panes 18, 20 to form an insulating air space 22 between the panes. The spacing members 24 usually contain a dessicant, not illustrated, which absorbs moisture from the air space 22 through the slot 26 provided in each spacing member 24, to help prevent internal fogging of the window 12 in cold weather. Sealant 28 holds the panes 18, 20 and the spacing members 24 together in a sealing relation to form the insulated window 12. Of course, although a double paned insulated window 12 is illustrated, it is understood that the window 12 could have more than two panes. The insulated window 12 forms no part, per se, of the present invention.

Figure 2:
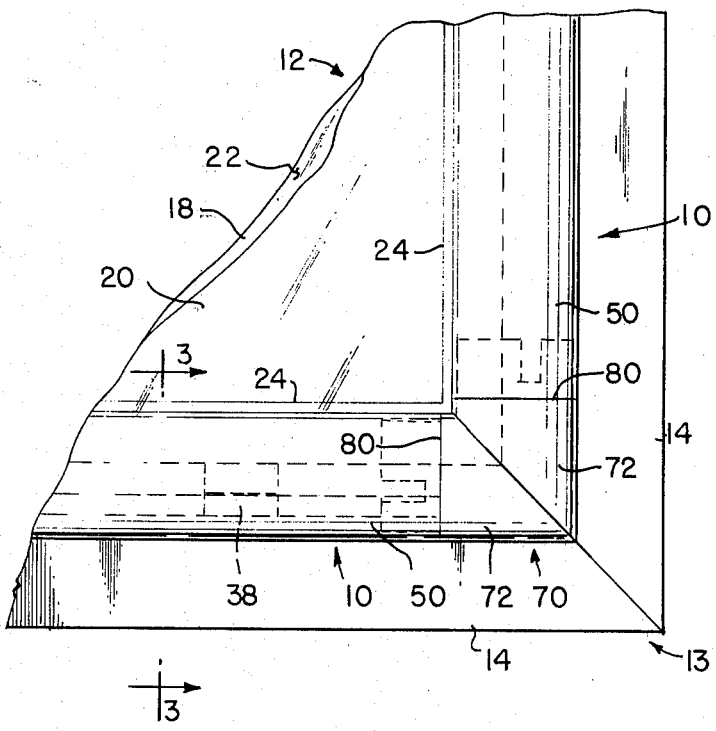
FIG. 2 is a front elevation view showing an insulated window being held in a window frame by the glazing bead of FIG. 1.
Figure 3:
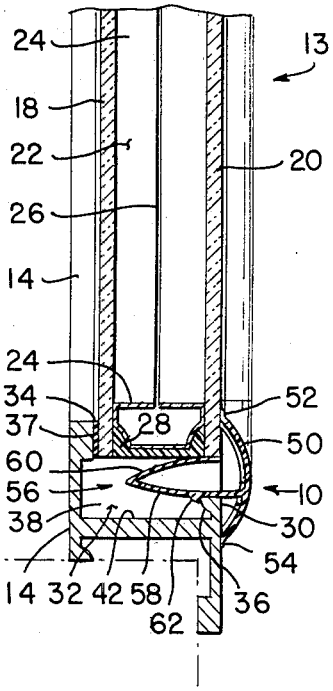
FIG. 3 is a cross sectional view taken along line 3—3 of FIG. 2.

The insulated window 12 is seated in a frame 13 having one frame member 14 for each side of the window 12, two frame members 14 being seen in FIGS. 2 and 3. The frame members 14 are of conventional construction and are held in an assembled relation by securing their ends together at the corners of the window 12 in the usual fashion, as by welding for example. It is to be understood that the frame members 14 seen in the figures are shown only by way of non limiting example, since the structure and cross sectional configuration of different commercially available frame members 14 may vary considerably. However, all frame members with which the glazing bead 10 of the present invention is useable will have two features in common, namely a glazing lip 30 and a glazing channel 32. The glazing channel 32 is generally defined between two imaginary parallel planes, the first imaginary parallel plane coinciding with the plane of the face 34 of the inner glass supporting member of the frame member 14, and the second imaginary parallel plane passing through the innermost edge 36 of the glazing lip 30. The cross sectional configuration and size of the glazing lip 30 depicted in the figures is also by way of nonlimiting example only, since these features of the glazing lip 30 on different commercially available frame members 14 may vary considerably. The frame members 14 form no part, per se, of the present invention.

In order to mount the insulated window 12 in its frame 13, glazing tape 37 and glazing blocks 38 are used, as well as the glazing bead 10 of the present invention. The glazing blocks 38 are best seen in FIG. 8 and each comprises a main body portion 40 which is sized to fit into the glazing channel 32 and to rest on the glazing channel's floor 42. A channel 44 is provided in the glazing block 38 to receive and be supported by the glazing lip 30 of the frame member 14 when the glazing block 38 is installed. One or two glazing blocks are installed in each frame member 14 and serve to properly center and support the insulated window 12 in its frame 13. The glazing 37 serves to secure and seal the edges of the inner pane of the insulated window 12 against the faces 34 of the inner glass supporting members of the frame members 14.

As has been mentioned, after the insulated window 12 is placed in its frame, the glazing bead 10 of the present invention is then used to help secure the window 12 in its frame 13, to help seal against the entry of wind and rain, and to help give a smart appearance to the installed window 12. The glazing bead 10, perhaps best seen in FIGS. 1 and 3, includes a resilient wall member 50 whose lateral edges 52, 54 are preferably rounded or beaded. Preferably, the wall member 50 has a generally arcuate cross sectional configuration, although other cross sectional configurations would likely work equally as well as long as the resulting wall member 50 was still somewhat resilient.

Extending outwardly from the wall member 50 is a resilient folded leg means, generally designated at 56, comprising a first leg member 58 which extends outwardly from the wall member 50 and then folds and reverses direction to form a second leg member 60. Extending outwardly from the first leg member 58 is a locking flange 62.

Although not illustrated, it would, of course, be within the scope of the present invention for the resilient folded leg means 56 to be reversed. That is, the glazing bead 10 seen in FIG. 3 would be turned over so the second leg member 60 would extend slightly downwardly, instead of slightly upwardly, with the locking flange 62 then being located on the second leg member 60, instead of on the first leg member 58, so it could properly engage the glazing lip 30.

The glazing bead 10 is preferably formed as an extrusion from any tough, resilient plastic, such as PVC; but might also be formed from extruded metal such as aluminum and is then cut to the desired length prior to installation.

The glazing bead 10 shown in FIGS. 1–3 is especially adapted to be used with an insulated window 12 about seven-eighths of an inch thick in a frame member 14 having a glazing channel 32 about three-quarters of an inch wide. In this situation, as seen, the insulated window 12 is so thick that it overlaps the glazing lip 30, and yet the glazing bead 10 of the present invention, due to its novel and unique construction, still works excellently. In addition, it will be apparent from the disclosures herein that the glazing bead 10 could easily be modified without departing from the scope of the present invention as claimed, to be useable with an insulated window 12 which did not fully overlap the glazing lip 30, or which did not even overlap the glazing lip 30 at all, without departing from the scope of the present invention.

Similarly, the glazing block 38, seen in FIG. 8 is intended to be used in situations where the installed window 12 at least partially overlaps the glazing lip 30, but does not extend much past the glazing lip 30. Preferably, the width of the glazing block 38 across its top 43 is at least about the same as the thickness of the window 12 it is designed to support, so as to give uniform support to the window 12. The glazing blocks 38 can be formed from any suitable, relatively thick, rubber or plastic material.

In order to install the glazing bead 10 of the present invention, one length thereof is inserted, with a snap fit, on each side of a previously assembled insulated window 12 and frame 13 combination. This done by first inserting the glazing bead's resilient folded leg means 56 between the window 12 and the glazing lip 30, and by then pushing on the resilient wall member 50 until the locking flange 62 engages the top inner edge 36 of the glazing lip 30. The locking flange 62 is held in an engagement with the glazing lip 30 by two forces. The first force is due to the fact that the resilient folded leg means 56 is sized and shaped so it is compressed when inserted between the window 12 and the glazing lip 30, thereby urging the locking flange 62 towards and into engagement with the glazing lip 30.

The second force is due to the fact that the resilient wall member 50 is preferably sized and shaped and the locking flange 62 is preferably positioned on the first leg member 58 in such a location that the wall member 50 will be held slightly compressed when the locking flange 62 engages the glazing lip 30. This compression of the resilient wall member 50 urges the locking flange 62 laterally towards and into engagement with the glazing lip 30, and also has the beneficial effect of tending to seal the rounded or beaded lateral edges 52, 54 of the resilient wall member 50 against the window 12 and its frame 13, to help prevent the entry of wind and rain.

Naturally, before each length of glazing bead 10 is installed, the position of the corresponding glazing blocks 38 are noted, and the folded leg means 56 is cut away for a distance sufficient to accommodate each corresponding glazing block 38. This removal of portions of the folded leg means 56 does not significantly impair the secure mounting of the glazing bead 10, since each glazing block 38 is typically only about an inch or two long.

Used in conjunction with the glazing bead of the present invention, is a glazing corner, generally designated at 70, seen in FIGS. 2, 4 and 5, which may be formed in one piece by injection molding from any suitable plastic, such as PVC; although aluminum could also be used. Glazing corners 70 are used to give a smart appearance to the glazing bead 10 at the corners of the installed window 12, and comprise two body portions 72 having an exterior profile substantially identical to that of the wall 50 of the installed glazing bead 10. Extending outwardly from each body portion 72 is a mounting flange 74 defining a mounting slot 76; and extending outwardly from the back of the body portions 72 is a mounting pin 78. As seen, each mounting flange 74 is recessed from its body portion 72 along a line 80 so that when the glazing beads 10 and the corners 70 are assembled in a window 12 and window frame 13 combination, the exterior surfaces of the glazing beads 10 and corners 70 will be substantially flush where they meet along lines 80.

To use a glazing corner 70, its mounting pin 78 is simply inserted between the window 12 and the window frame 13 at the corner of the frame 13. The pin 78 serves to properly locate the corner 70 while and after its corresponding glazing beads 10 are snapped into place over it with their folded leg means 56 extending through corresponding slots 76 and their free ends abutting their corresponding lines 80 on the corner 70. The glazing corners also offer the advantage that when they are used, the glazing beads 10 do not have to have 45 degree corresponding cut ends for each corner of the frame 13.

Referring now to FIG. 3, most window frames 14 which are designed to or may use some form of a glazing bead to secure a non insulated window or a one-half inch thick insulated window into the frame 14 have a very important similarity. The similarity is that their glazing channels 32 are all about three-quarter of an inch wide even though the cross sectional configuration and sizing of the glazing lips 30 will vary. Accordingly, it is preferred that the locking flange 62 be fairly short or stubby, so it will be able to engage the top, inner edge 36 of the glazing lip 30 despite whatever other cross sectional configuration and size the glazing lip 30 might have. Of course, although not preferred, it would be possible to custom make a different glazing bead 10 having a custom locking flange 62 for each different glazing lips encountered; or having multiple locking flanges 62 arranged parallel to each other on the folded leg member 56 so that one of them would engage the glazing lip 36 on the window frame 14.

Turning now to FIGS. 6 and 7, a second form 82 and a third form 84 of the glazing bead of the present invention are illustrated, respectively. This forms 82 and 84 are identical in structure, functioning and use to the form 10 as illustrated in FIGS. 1–3 and discussed above, except for their differences which are discussed below. In view of their similarities, similar features have been given the same reference numerals, for purposes of clarity.

The form 82 of FIG. 6 differs from the form 10 of FIGS. 1–3 in that its resilient wall member 50' has a portion 51 with an increased arc beyond its first leg member 58 of its folded leg means 56. Thus, when the form 82 is installed less of the frame (mullion 105) is covered by the portion 51, so that the form 82 will accommodate the flange 107 on movable Z-Bar vent frame 109. A seal is provided between the glazing bead 82 and the frame member 105 by the contact of its first leg member 58 and locking flange 62 with the glazing lip 30'.

The form 84 of FIG. 7 differs from the form 10 of FIGS. 1–3 in several respects which will be better appreciated when it is understood that it is intended to be used when the insulated window 12 is so thick that its outer pane 20 extends past the glazing lip 30 of the frame member 14 for a substantial distance, as clearly illustrated in FIG. 7.

Thus, in order to compensate for the overhang of the window 12 past the outer surface 86 of the glazing lip 30, the locking flange 88 has been moved to the left somewhat, as viewed in FIG. 7, and a foot 90 has been added to the lower end of the wall member 50'. From the foregoing disclosures, it will now be apparent, to one skilled in the art, how to modify the glazing beads 10, 84 to accommodate insulated windows 12 which extend past the outer surface 86 of the glazing lip 30 to greater or lesser degrees, without departing from the scope and spirit of the present invention as claimed.

Turning now to FIG. 9, another form 92 of glazing block is illustrated which is generally similar in use, shape and function to the form 38 shown in FIGS. 2 and 8, except that the form 92 is designed to be used in situations where the window 12 is so thick that it extends past and overhangs glazing lip 30, such as illustrated in FIG. 7. The glazing block 92 comprises a lower rubber or plastic portion 94 adhered to an upper metal portion 96. The lower portion 94 is sized to fit into the glazing channel 32 and rest on the glazing channel's floor 42. A channel 98 is provided in the lower portion 94 to receive and be supported by the glazing lip 30 when the glazing block 92 is installed in the frame member 14. The width of the glazing block 92 across its top 100 is at least about the same as the thickness of the window 12 it is designed to support, so as to give uniform support to the window 12. The metal top portion 96 serves to reinforce the glazing block 92 and provide proper support for the window 12, even in those areas where the top portion 96 extends past and is not directly supported by the glazing lip 30.

From the foregoing, various further applications, modifications and adaptations of the articles disclosed by the foregoing preferred embodiments of the present invention will be apparent to those skilled in the art to which the present invention is addressed, within the scope of the following claims.

What is claimed is:

1. A glazing bead adapted to secure a second, larger thickness of insulated window means in a window frame means designed to normally receive a first, smaller thickness of insulated or uninsulated window means, wherein the window frame means is of the type having a glazing channel terminating on one side in a glazing lip, wherein the glazing bead comprises:

resilient wall means adapted to engage, when installed, the window means and the window frame means;

locking means adapted to engage, when installed, the inner edge of the glazing lip on the window frame means;

resilient folded leg means, wherein said folded leg means comprises first leg member means which extend outwardly from said wall means and then folds and reverses direction to form second leg member means which extend towards said wall member means, wherein said locking means extends outwardly from said folded leg means;

wherein, when said glazing bead is installed, said resilient folded leg means is adapted to be compressed between said window means and said window frame means and urge said locking means towards said frame means into engagement with said glazing lip; and wherein, when said glazing bead is installed, said resilient wall means is adapted to be compressed and resiliently urge said locking means laterally towards and into engagement with said glazing lip; and wherein said compression also tends to bring said resilient wall means into firm contact with at least one of said window means and said window frame means.

2. The glazing bead according to claim 1, wherein said resilient wall means has a generally arcuate cross sectional configuration.

3. The glazing bead according to claim 1, wherein at least a portion of said resilient wall means has a generally arcuate cross sectional configuration.

4. The glazing bead according to claim 1, wherein said locking means comprises flange means which extend outwardly from said folded leg means.

5. The glazing bead according to claim 4, wherein said flange means extend outwardly from said folded leg means for a distance just sufficient to enable said flange means to engage the outermost portion of the inner edge of the glazing lip when said glazing bead is installed.

6. The glazing bead according to claim 1, wherein said locking means extend outwardly from said first leg member means.

7. The glazing bead according to claim 1, wherein said glazing bead is a one piece plastic extrusion.

8. The glazing bead according to claim 1, wherein said glazing bead is adapted to be installed with a snap fit into a previously assembled combination window means and window frame means.

9. The glazing bead according to claim 1, wherein the window frame means is a mullion means, and the resilient wall means is sized and curved so as to be adapted to avoid interference with a second window means of the type having a Z-Bar vent frame which is movable into contact with the mullion means.

10. The glazing bead according to claim 1, wherein, when the glazing bead is installed, said resilient wall means are adapted to engage both said window means and said window frame means.

11. The glazing bead according to claim 1, wherein said glazing bead is adapted to secure an insulated window in said window frame means wherein the thickness of said insulated window is such that the insulated window overlaps the glazing lip on said window frame means when installed therein.

12. The glazing bead according to claim 1, wherein said glazing bead is adapted to secure an insulated window in said window frame means wherein the thickness of said insulated window is such that the insulated window extends past the glazing lip on said window frame means when installed therein.

13. The glazing bead according to claim 12, wherein said resilient wall means include foot means which extend outwardly from said resilient wall means and engage said window frame means when said glazing bead is installed.

14. A glazing bead adapted to secure a window means in a window frame means, wherein the window frame means is of the type having a three sided glazing channel having a floor, a glass supporting member extending upwardly from one side of the floor and a glazing lip extending upwardly from the other side of the floor, wherein said glass supporting member is adapted to support a face of said window means, wherein the edge of said window means is located generally between said glass supporting member and said glazing lip, and wherein the glazing bead comprises:

resilient wall means adapted to engage, when installed, at least said window means;

locking means adapted to engage, when installed, said glazing lip on the window frame means; and curved, resilient leg means, wherein said leg means extend outwardly from said wall means; wherein said locking means extends outwardly from said leg means; and wherein, when said glazing bead is installed, said leg means is adapted to be compressed between said window means and said window frame means to urge said locking means toward said frame means and into engagement with said glazing lip.

* * * * *